United States Patent [19]

Caines

[11] 4,432,408

[45] Feb. 21, 1984

[54] METHOD AND COMPRESSED VERMICULAR EXPANDED GRAPHITE APPARATUS FOR HEAT EXCHANGING

[75] Inventor: Ronald S. Caines, Stone Mountain, Ga.

[73] Assignee: The Dow Chemical Co., Midland, Mich.

[21] Appl. No.: 399,386

[22] Filed: Jul. 19, 1982

[51] Int. Cl.[3] ..... F28D 9/00; F28F 3/08

[52] U.S. Cl. ..... 165/1; 165/154; 165/164; 165/DIG. 8

[58] Field of Search ..... 165/154, 164, 165, DIG. 8, 165/1

[56] References Cited

U.S. PATENT DOCUMENTS

| | | | |
|---|---|---|---|
| 2,047,080 | 7/1936 | Maniscalco | 165/52 |
| 2,825,688 | 3/1958 | Vernon | 376/373 |
| 2,887,303 | 5/1959 | Reys | 165/165 X |
| 3,106,957 | 10/1963 | Cannon | 165/165 X |
| 3,265,124 | 8/1966 | Reys | 165/133 |
| 3,323,869 | 6/1967 | Olstowski | 423/448 |
| 3,327,777 | 6/1967 | Kovalik et al. | 165/81 |
| 3,389,964 | 6/1968 | Olstowski | 423/448 |
| 3,448,181 | 6/1969 | Olstowski et al. | 264/120 |
| 3,492,197 | 1/1970 | Olstowski et al. | 428/412 |
| 3,627,551 | 12/1971 | Olstowski | 252/506 |
| 3,821,369 | 1/1958 | Hilliard | 165/165 X |

OTHER PUBLICATIONS

Hills, Graphite Heat Exchangers—II, Chemical Engineering, Jan. 20, 1975, pp. 116–119.

Hills, Graphite Heat Exchangers—I, Chemical Engineering, Dec. 23, 1974, pp. 80–83.

*Primary Examiner*—Sheldon J. Richter

*Attorney, Agent, or Firm*—Merton B. Lilly

[57] ABSTRACT

Method of and apparatus for exchanging heat between two fluids wherein a core member is composed essentially of vermicular expanded graphite which has been compressed primarily along one axis and heat is exchanged in the core member between the two fluids along an axis normal to the primary axis of compression of the core member.

12 Claims, 9 Drawing Figures

METHOD AND COMPRESSED VERMICULAR EXPANDED GRAPHITE APPARATUS FOR HEAT EXCHANGING

This is a divisional of application Ser. No. 48,127, filed June 13, 1979, U.S. Pat. No. 4,355,684.

BACKGROUND OF THE INVENTION

When heat is to be exchanged between one or more fluids which are at high temperatures or which are chemically corrosive, the heat exchanger must be constructed of special materials designed to resist chemical corrosion and to remain stable at high temperatures. This is especially true of the core member of the heat exchanger which is that portion of the heat exchanger wherein transfer of heat from one fluid to another occurs. Materials which have been used in the past have included special metals and alloys thereof, as well as carbon in its various forms, including graphite.

Graphite heat exchangers have a number of advantages which make them especially desirable for high temperature, high chemical corrosion usage. For example, graphite withstands thermal shock to a limited extent and is quite resistant to chemical corrosion, with the exception of certain strong oxidizing chemicals. Furthermore, graphite structures have excellent stability at temperatures up to about 350° F., as well as good thermal conductivity. There are certain disadvantages to graphite structures which limit their use in heat exchangers. For example, graphite has relatively low tensile strength, so that tubes made of graphite are relatively fragile. Graphite is also porous and permeable to various fluids. This permeability may be overcome by impregnating the graphite with certain synthetic resins, but this reduces the stability of the graphite-synthetic resin compositions at high temperatures. Furthermore, conventional synthetic graphite is made of randomly oriented crystals which limit the effectiveness with which heat can be conducted. Graphite heat exchangers have been designed to take advantage of the good compressive strength and other advantages of graphite, while at the same time minimizing its disadvantages, such as poor tensile strength. For example, U.S. Pat. Nos. 2,821,369; 2,887,303 and 3,106,957 show graphite heat exchangers wherein the core member is made up of a number of graphite blocks. These blocks are held within a shell in a relationship such that holes bored through the blocks are interconnected in such a manner as to permit the exchange of heat between the fluids passing through the core. In certain instances, these blocks may be glued together so that the core member is essentially a monolithic block. U.S. Pat. Nos. 3,265,124 and 3,327,777 disclose the use of graphite tubes, either composed entirely of graphite or a composite tube containing an inner or outer shell which helps to support the graphite. One thing that each of these designs has in common is that they are expensive to produce and difficult to repair.

SUMMARY OF THE INVENTION

This invention resides in a method of an apparatus for exchanging heat between two or more fluids. The method comprises passing a first fluid through a core member made by compressing a composition containing essentially vermicular expanded graphite substantially more along one axis than the other two axes, and passing a second fluid through said core member in separate but heat exchange relationship with said first fluid in such a manner that heat is exchanged between the two fluids along an axis of the core member that is normal to the axis of substantial compression under which said core member is formed.

The apparatus is a heat exchanger comprising a core member, made as described above in the method that comprises the invention, a first means for passing a first fluid through said core member and a second means for passing a second fluid through said core member in separate but heat exchanging relationship with said first fluid, said first and second means being so positioned with respect to one another that the heat exchanged between the two fluids is along an axis of the core member that is normal to the axis of substantial compression under which said core member is formed.

DETAILED DESCRIPTION OF THE INVENTION

There has been wide industrial use of heat exchangers wherein two or more fluids at differing temperatures exchange heat to raise the temperature of one fluid and to lower the temperature of the other. Heat exchangers are generally constructed of a container or shell and a core member positioned within the shell. In operation, a first fluid is introduced into the shell, passes through or around the core member and out another portion of the shell. A second fluid is likewise introduced into the shell and passes through a multiplicity of holes or passageways in the core member which are closely adjacent those passageways through which the first fluid is passing. Thus, there is an efficient exchange of heat between the two fluids. In commercial operations, the fluid which is to be heated or cooled is called the process fluid and the fluid which provides the heat or absorbs heat is called the service fluid. These fluids may be gases or liquids or, as in the case of steam that condenses within the core, a mixture of both.

In the present invention, the core is composed essentially of vermicular expanded graphite that has been compressed. Vermicular expanded graphite is a low bulk density (usually between about 0.002 and about 0.02 gram/cubic centimeter), particulate, worm-like form of graphite. It is prepared by treating natural flake graphite with an intercalating agent, such as fuming nitric acid, fuming sulfuric acid, or a mixture of concentrated nitric and sulfuric acid. The treated graphite is then heated to a high temperature, e.g., above about 500° C., to expand the natural flake graphite to the lightweight, vermicular form. The preparation of the vermicular expanded graphite is well known in the art, and is described in greater detail, for example, in U.S. Pat. Nos. 3,389,964 and 3,323,869.

Vermicular expanded graphite can be compressed into various shapes and forms, either by itself or in admixture with additives which impart desired characteristics to the shaped product. Structures made of compressed expanded graphite are described in U.S. Pat. Nos. 3,492,197 and 3,627,551. Some of the additives, such as bonding agents, that may be employed are described in U.S. Pat. No. 3,627,551 and include (1) any solid organic polymer, (2) other organic compounds which, upon pyrolysis, yield a cementing char, and (3) inorganic glass-like bonding agents.

Because compressed expanded graphite is first formed as light, fluffy "worms", it may be pre-coated with a wide variety of additives. Conventional synthetic graphite is formed in large blocks that are machined to the desired shape. Thus, additives for conventional graphite are restricted to those that can be dissolved in a fluid of relatively low viscosity. This eliminates numerous additives, such as polytetrafluoroethylene polymers.

Structures or core members made with compressed expanded graphite are anisotropic in that electrical and thermal conductivity, for example, is much greater in the axis normal or perpendicular to the axis of compression than in the axis of compression. This exceptional conductivity along the axis normal to the axis of compression arises from the fact that compression orients the graphite crystals along this axis. For example, the heat conductivity along the axis of compression may be 1/100 of that along the axis normal to such axis of compression. Because of the random orientation of crystals in conventional synthetic graphite, this anistropicity is usually of the order of 1 to 4. Structures made with compressed expanded graphite become less anisotropic or lose entirely this property when compressed along two or more axes. In the present invention, however, it is preferred that the core member be compressed substantially more along one axis than along the other axes. In compressing vermicular expanded graphite in molds, there will be some peripheral compression, but this is substantially less than the compression normal to the periphery. Unlike ordinary graphite, compressed expanded graphite does not have pores, although structures made of compressed expanded graphite have a certain amount of permeability. This permeability is decreased as the density of the structure (or the amount of compression) increases. For purpose of the present invention, densities in the order of about 100 pounds per cubic foot are desired. Since structures made with compressed expanded graphite have some tendency to exfoliate, it is necessary to maintain some compression on such structures along an axis parallel to the original axis of compression during the use of such core members. Core members thus made can have densities of 100-120 pounds per cubic foot, and may even approach the theoretical density of graphite of about 140.5 pounds per cubic foot.

Core members which are made with compressed expanded graphite to which additives have been added can have properties that are markedly different from core members made solely from the compressed expanded graphite. This is particularly true when such additives are bonding agents, for example. As used herein "bonding agents" are meant to include agents that promote adherence among those particles which make up the composite graphite form, either physical or chemical. Bonding aterials which are preferred in the instant application include glass forming compositions and polymeric organic compounds containing halogens, such as polytetrafluoroethylene. These bonding agents have considerable stability at high temperatures and are resistant to corrosion by chemicals. Furthermore, core members made with compressed expanded graphite bonded with these materials are much less permeable to fluids and the tendency to exfoliate may be diminished or entirely eliminated. The bonding agents may be employed in widely varying amounts, for example, from about 3 to about 50 weight percent based on the total weight of vermicular expanded graphite plus bonding agent. The structures may be formed by compressing the vermicular expanded graphite under pressure, such as from about 5 to about 50 pounds per square inch. The compressed form or core member is then heated to sinter the bonding agent, as described in U.S. Pat. No. 3,627,551.

It will be recognized by those skilled in the art that certain "bonding agents" may, in fact, function by coating the graphite particles and reducing their wettability or permeability or otherwise altering their properties. In which case, they may or may not be true "bonding agents" in the sense of promoting adhesion. Also, it will be apparent to those skilled in the art that the order the steps of compressing and sintering may be varied to obtain the most satisfactory product.

The cores made in accordance with the present invention may have a variety of shapes. A number of such shapes have already been disclosed in U.S. Pat. Nos. 2,821,369; 2,887,303 and 3,106,957. In addition to those illustrated in these U.S. Patents, core members may be made from a single block of compressed expanded graphite, or may be made up of a plurality of plates held together so as to form a single core member.

Details of the design and construction of core members comprising the present invention, as well as the operation of the heat exchangers made therewith, will be set forth hereinbelow in connection with the accompanying drawings wherein.

Figure 1:
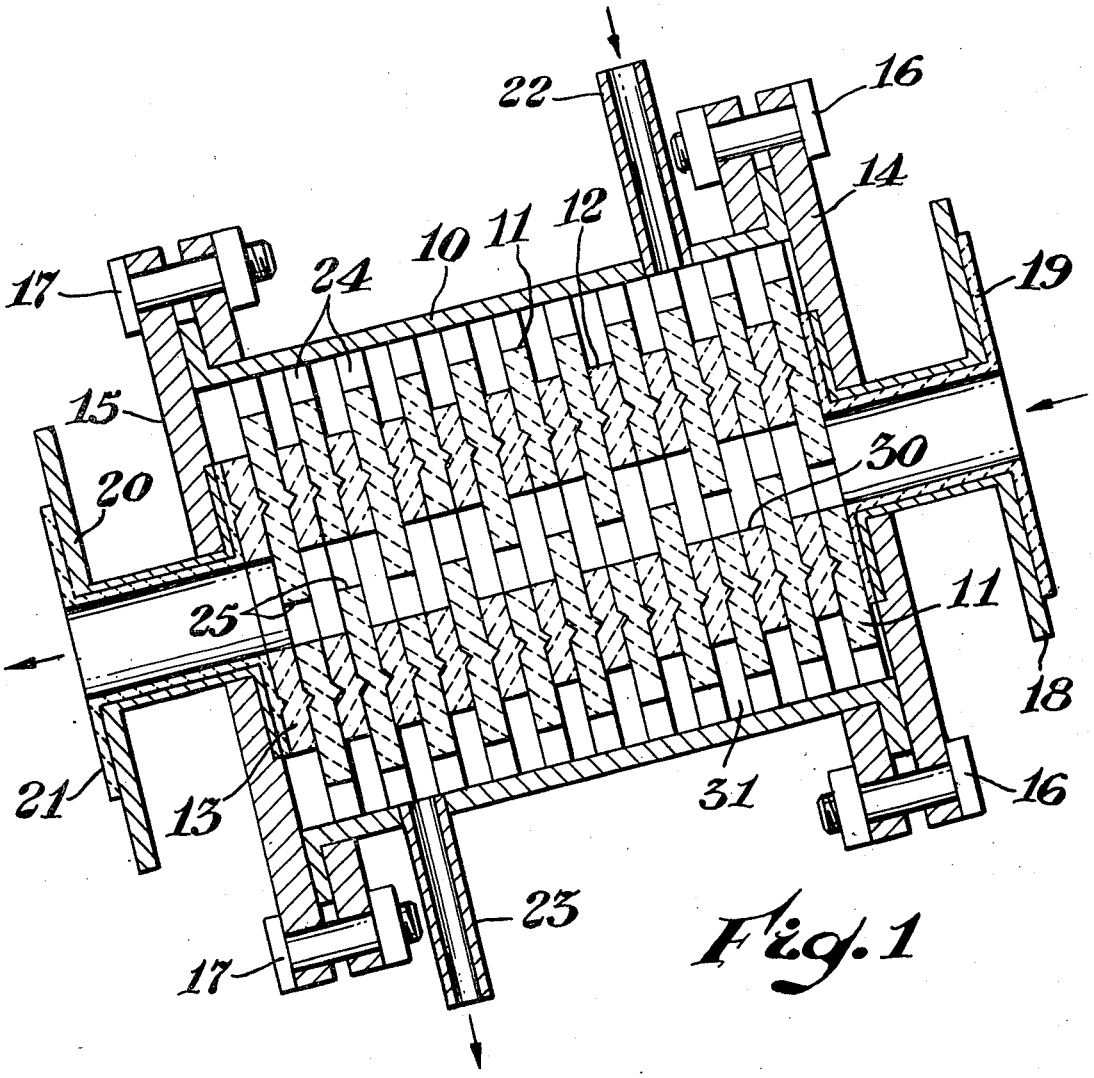
FIG. 1 is a side elevation in section of a heat exchanger.
Figure 4:
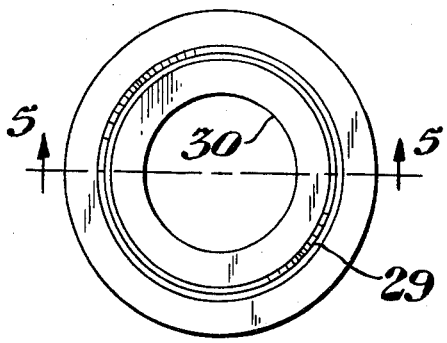
Figure 5:
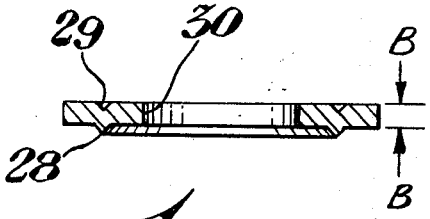
Figure 6:
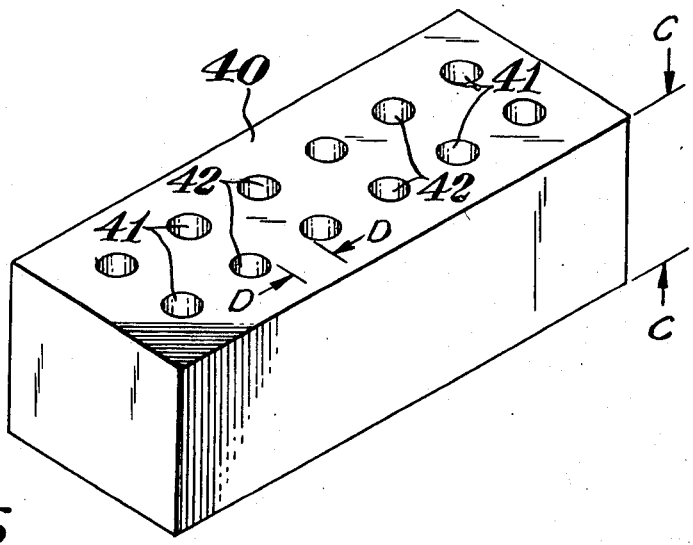
Figure 7:
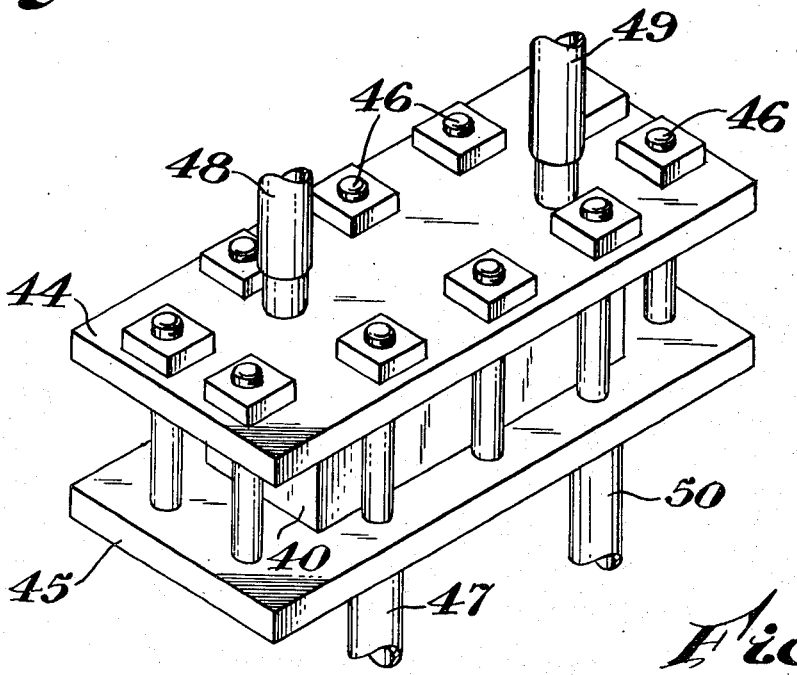
Figure 8:
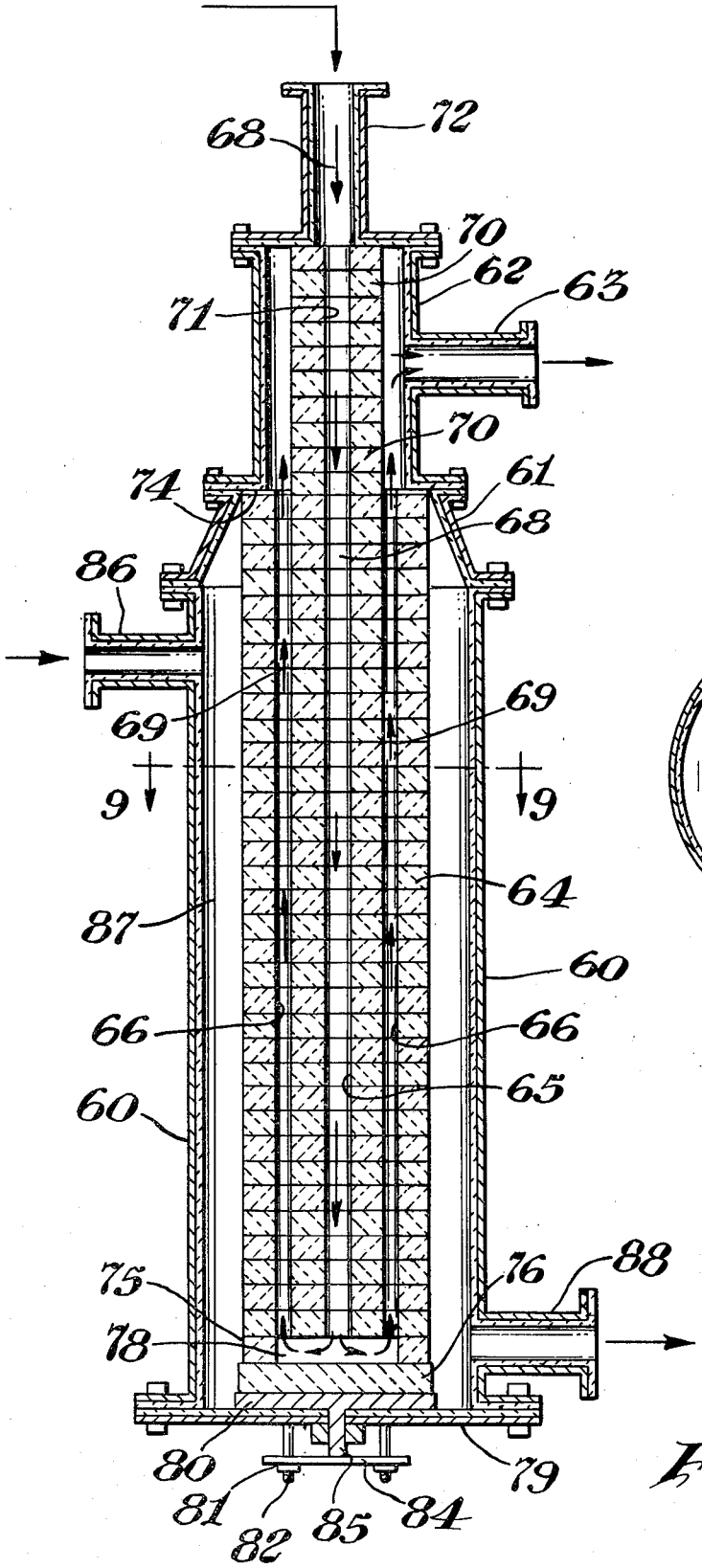
Figure 9:
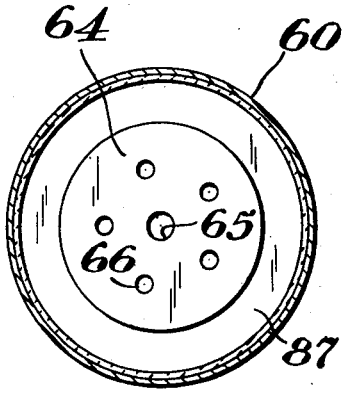

FIG. 4 is a plan view of a spacer ring shown in the heat exchanger of FIG. 1, FIG. 5 is a cross section taken on line 5—5 of FIG. 4, FIG. 6 is a perspective view of a second embodiment of the present invention, FIG. 7 is a perspective view of a heat exchanger constructed using the core member shown in FIG. 6, FIG. 8 is a schematic view, in cross section, of another modification of the present invention, and FIG. 9 is a section taken on line 9—9 of FIG. 8.

A preferred embodiment shown in FIG. 1, comprises a container or cylindrical shell 10 which encloses a core member 13 (indicated generally) which is made up of a multiplicity of plates 11 and spacer rings 12. Both the plates and the spacer rings are made by compressing vermicular expanded graphite in a nanner hereinafter described. Headers 14 and 15 at opposite ends of the shell 10 are bolted to the shell by means of bolts 16 and 17, respectively, thus making the ends of the shell 10 fluid tight. A metal spool 18 extends through the header 14 and has compressed expanded graphite lining 19 so as to provide a corrosion resistant inlet for the process fluid, as hereinafter described. A silicone rubber gasket (not shown) may be positioned between the inner flange of the spool 18 and the header 14 in order to prevent leakage of service fluid, such as steam, from the shell 10. At the other end of the cylindrical shell 10, a second metal spool 20 having a compressed expanded graphite liner 21 extends through the header 15 and may likewise use a silicone rubber gasket (not shown), as described above in connection with spool 18. A nipple 22 provides an inlet for service fluid into the shell 10. A second nipple 23, positioned 180° from the first nipple 22 provides an outlet for the service fluid from shell 10.

Figure 2:
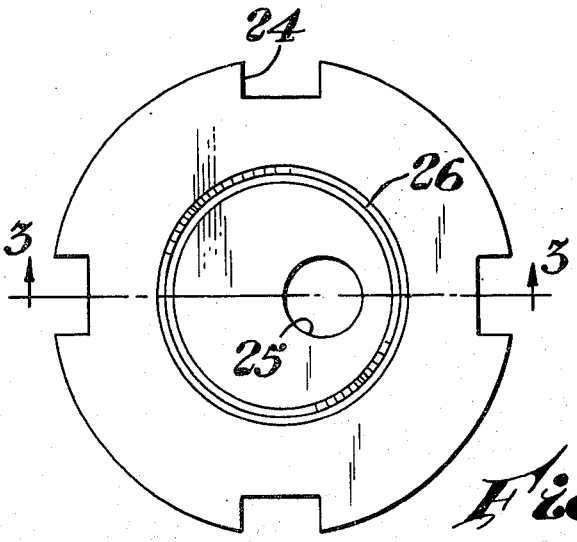
FIG. 2 is a plan view of a plate shown in the heat exchanger of FIG. 1.

Each plate 11 has four slots 24 formed in its periphery and spaced at 90° from one another (see FIG. 2). Each plate 11 also has an off-center hole 25 positioned tangential to the central axis of each plate. As seen in FIG. 1, the central holes 25 are rotated at 180° from one plate to each adjacent plate, so that process fluid flowing therethrough must follow a circuitous path and thus reduce any film effect in the interior of the core member 13. Alignment grooves 26 are formed in one side of each plate and are complemented on the other side of the plate by alignment ridges 27 (see FIG. 3). The spacer rings 12 likewise have alignment grooves 29 formed therein (note particularly FIG. 5) which are adapted to align with and key into the alignment grooves and ridges formed in the plates 11 (as shown in FIG. 1). As shown in FIGS. 4 and 5, the spacer rings 12 have a central opening 30 which is approximately twice the diameter of the holes 25 formed in the plates. Consequently, the holes 25 in the plates 11, in combination with the openings 30, form a continuous passageway through the central portion of the core member 13 as shown in FIG. 1. Because the spacer rings are smaller in diameter than the plates, there are spaces 31 between the periphery of the spacer rings 12 and the shell 10. These spaces 31, together with slots 24 form a peripheral passageway through and about the core member 13 for the service fluid.

In assembling a heat exchanger as shown in FIG. 1, one header, for example 15, is bolted onto the one end of the shell 10, and plates and spacers are then alternately slid into the shell 10 to form a core member as shown in FIG. 1. The diameter of the plates 11 approximate the inner diameter of the shell 10 and thus fit snuggly within the shell. The alignment ridges 27 in the plates 11 seat in the alignment grooves 29 in the spacers 12 and the alignment ridges 28 of the spacers seat in the alignment grooves 26 of the adjacent plate, thus forming in effect a unitary core member 13. The number of spacer rings and plates employed is such that they more than fill the space between header 15 and header 14. Consequently, when the header 14 is bolted on and bolts 16 are tightened down, the plates 11 and the spacer rings 12 are held under compression between the headers 14 and 15 and, at the same time, the headers seal both ends of shell 10. While the amount of compression on the plates and spacer rings may vary widely, pressures of at least 100 pounds per square inch and, preferably, 500 pounds per square inch have been found desirable in avoiding exfoliation of the plates and leakage in the core.

In the operation of the heat exchanger shown in FIG. 1, service fluid, for example steam, is introduced through the nipple 22 (note arrow), circulates through slots 24 and spaces 31 and leaves the shell 10 through nipple 23 as condensate. When steam is used, the core member 13 becomes heated. Process fluid, which is to be heated in this particular example, is introduced, as shown by the arrow in FIG. 1, through the metal spool 18, is introduced into the shell 10 through the metal spool 18 and follows the tortuous path through the center of core member 13 provided by holes 25 and central openings 30. The heated process fluid then leaves the shell through the metal spool 20. It will be apparent to those skilled in the art that the process fluid may flow in a direction counter-current to the service fluid, which is just the reverse direction frcm that shown in FIG. 1.

Figure 3:
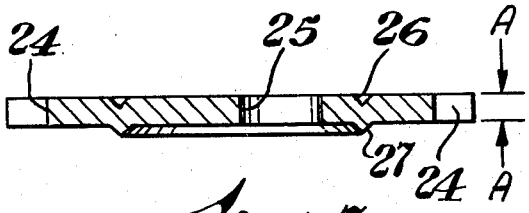
FIG. 3 is a cross section taken on line 3—3 of FIG. 2.

Plates 11 and spacer rings 12 are both produced from vermicular expanded graphite by compressing both the plates and spacer rings along the axis of their thickness, which is indicated in FIG. 3 as A—A for the plates and in FIG. 5 as B—B for the spacer rings. The compression of the plates and spacer rings between the headers 14 and 15 is along this same axis. This prevents exfoliation during the operation of the heat exchanger and effects the fluid tight seal (due to the self gasketing nature of compressed expanded graphite) between the spacer rings and the plates. The primary movement of heat from the service fluid to the process fluid is radially, from the periphery of the plates and the spacer rings toward the process fluid passing centrally of the core member 13. Because of the anisotropy of the compressed expanded graphite, thermal conductivity in the axis normal to the axis of compression is several times what it is along the axis of compression. Consequently, radial movement of the heat through plates 11 and spacer rings 12 is greatly promoted and the heat exchange between the service fluid and process fluid is highly efficient.

A second embodiment of the present invention is shown in FIGS. 6 and 7. In FIG. 6, a monolithic core member 40 may be made from pure (no additives), compressed expanded graphite or from expanded graphite to which a bonding agent has been added. There are various ways in which the core member may be produced. In one particular modification, pure vermicular expanded graphite was compressed into sheets and a plurality of these sheets were then laminated together by compression along the axis of thickness of the sheets. This laminated structure then formed the monolithic block for core member 40. Bonded expanded graphite may be utilized in the same manner. Core members thus made are compressed along the axis C—C as shown in FIG. 6.

A number of holes are then bored in the core member 40. Holes 41 provide passageways for service fluid while holes 42 provide passageways for process fluid. Obviously, the arrangement of holes 41 and 42 may be varied to suit the particular needs of the heat exchanger in question. Transfer of heat between the two fluids is along the axis D—D as shown in FIG. 6. This axis, D—D, is normal or perpendicular to the axis of compression C—C. Because of the anisotropic properties of the compressed expanded graphite used to produce the core, thermal conductivity along axis D—D is quite high and relatively low along axis C—C. Header plates (not shown) of compressed expanded graphite are designed so that the path of the two fluids through holes 41 and 42, respectively, form a double helix. As shown in FIG. 7, header covers 44 and 45 fit over the header plates and hold the entire core member 40 assembly under compression when the nuts on bolts 46 are tightened. The direction of compression caused by the tightening of the nuts on bolts 46 is along axis C—C, which is the same axis of compression as that under which the core member was formed. This prevents exfoliation of the compressed expanded graphite during use, and also eliminates or reduces leakage of fluids through the core member under use conditions. Also, the maintenance of the core member under compression aids in retaining the anisotropic characteristics of the compressed expanded graphite from which the core is formed, so that heat transfer along the axis D—D remains high throughout use. The amount of compression that is required to prevent exfoliation for core members made from pure compressed expanded graphite is much higher than that for core members made using bonding agents. Certain bonding agents will in themselves prevent exfoliation and essentially eliminate the passage of fluid through the core member. Consequently, the compression caused by the tightening of bolts 46 can be reduced or essentially eliminated when bonded compressed expanded graphite is employed An inlet conduit 50 leads the service fluid in through header cover 45 and into the core member holes 41. An outlet conduit 47 is likewise connected to holes 41 in the core member and provides a passageway out of the core member and through the header cover 45 for the service fluid. In a somewhat similar manner, an inlet conduit 48 for process fluid leads in through the header 44 into the core member 40 through holes 42. An outlet conduit 48 for the process fluid is likewise connected to the holes 42 in the core member 40 and provides a passageway from the core member and out through the header 44.

Suitable grooves are provided in the interior faces of graphite blocks (not shown) interposed between core member 40 headers 44 and 45 to interconnect holes 41 with one another. A second set of grooves in interior faces of headers in these same graphite blocks (not shown) interconnect holes 42 with one another.

Still another embodiment of the present invention shown schematically in FIG. 8 comprises a metal, cylindrical shell 60 having a concentric reducer 61 bolted to one end thereof and a graphite-lined, T-shaped pipe 62 bolted to the smaller end of the reducer 61. A graphite-lined outlet nozzle 63 is located in one side of pipe 62. A core member inside the shell 60 is composed of a series of compressed expanded graphite plates 64, each having a concentric hole 65 with two or more smaller openings 66 disposed radially from hole 65, best viewed in FIG. 9. These plates 64 are stacked on one another so that the holes 65 and openings 66 in each plate are aligned with similar holes and openings in the other plates so as to form a fluid-in passageway, indicated generally by the arrow 68, and a plurality of return passageways, indicated generally by the arrows 69. A second series of smaller graphite plates 70 are stacked on one another in the T-shaped pipe 62. Each plate 70 has a single concentric hole 71 aligned with holes 65 of the plates 64 so as to form a continuation of the fluid-in passageway 68.

A graphite-lined entry nozzle 72 is bolted to the upper end of pipe 62 and, together with the lower flange 74 of pipe 62, provides means for holding the upper end of the core member in a fixed position. At the lower end of the core member, a ring-shaped, compressed expanded graphite distributor disc 75 and a solid disc 76 of similar material combine to form a connecting chamber 78 which interconnects with the fluid-in passageway 68 with the return passageways 69. A header plate 79 is bolted to the bottom of the shell 60 and has mounted thereon a metal support 80 which can be adjusted by means of nuts 81, mounted on bolts 82, which carry a plate 84 bearing against a lug 85 formed on the support 80. An inlet 86 in the shell 60 directs fluid into the space 87 and about the outer periphery of the core member. This fluid exits from the shell through outlet 88.

In the operation of the heat exchanger shown in FIG. 8, steam or other heated fluid enters through inlet 86, flows about and heats the core member made up of plates 64 and passes out of shell 60 through the outlet 88. Process fluid enters at the top of the exchanger through nozzle 72 and passes down the core member through passageway 68. At the bottom of the core member, the process fluid is distributed in the distributor chamber 78 to the several return passageways 69. As the process fluid moves upwardly through passageways 69, it is heated by the steam in the space 87 and, in turn, heats the incoming process fluid in passageway 68. As this return process fluid flows into the pipe 62 toward the outlet nozzle 63, it heats the exterior of plates 70, which in turn transmit this heat to the incoming process fluid.

The embodiment of the invention shown in FIG. 8 thus provides means to preheat the process fluid, and positions a plurality of return passageways closely adjacent the heating fluid for more efficient heat exchange.

The following examples are set forth by way of explanation rather than limitation.

EXAMPLE 1

A heat exchanger, as shown in FIGS. 1-5 inclusive, was made and tested in the following manner: Pure vermicular expanded graphite was agglomerated in a Waring blender on low speed for 10 seconds. The purpose of agglomeration was merely to reduce the volume of vermicular expanded graphite that had to be loaded into each plate dye. The agglomerated expanded graphite was then loaded onto the plate dye and sealed in a container on which a vacuum was pulled for at least 15 minutes. The graphite was then subjected to a compression of 7,000 pounds per square inch along the axis A—A as shown in FIG. 3. Some forty-three plates were manufactured in this manner and each had a thickness of approximately 5/16 inch. Spacer rings were produced in a like manner, using 75 grams of the agglomerated expanded graphite which was loaded into a spacer dye, a vacuum pulled on the graphite for at least 15 minutes and then the expanded graphite was subjected to a pressure of 20,000 pounds/square inch along the axis B—B as shown in FIG. 5. Forty-three spacer rings were thus made, each having a thickness of approximately ¼ inch. The plates were each approximately 6 inches in diameter and the spacer rings were approximately 4 inches. The shell 10 was made up out of a 24 inch long spool of 6 inch internal diameter stainless pipe flared on the ends. This pipe was bored to an internal diameter sufficient to allow a snug fit for the 6 inch plates, and 1 inch stainless steel nipples were attached at opposite ends 180° around the pipe from one another for the service inlet and outlet, respectively. The heat exchanger was assembled by bolting on one header assembly to one end of the shell and then stacking the plates and spacers alternately within the shell so that a series of slots 24 of the plates 11 line up with nipples 22 and 23, respectively, as shown in FIG. 1. Each plate was rotated 180° with respect to the neighboring plate in order to cause a one inch offset of the holes 25 and thus form a zigzag path for process fluid through the central portion of the core member 13, which is composed of the plates and spacer rings. Enough plates and spacer rings were stacked in the shell to fill the entire 24 inch length of shell plus an extra inch. Thus, when the second header was bolted onto the opposite end of the shell, the spacers and plates within the shell were compressed so that a seal was effected, not only between the plates and spacers but also between the interior flanges of graphite lined metal spools 18 and 20 and the spacer rings and plates forming the core member 13. In this particular embodiment of the invention, silicone rubber gaskets were employed to seal the backside of these two graphite-lined spools, 18 and 20, against the possible leakage of steam from the shell.

This heat exchanger was tested by running 5° C. tap water in the process side (through spool 18) and heating it by putting 150 pound steam into the service side through nipple 22. The steam pressure was monitored by a pressure gauge on the exit nipple 23 and the water in and out temperatures were monitored by means of a thermocouple. Table I sets forth below the data and various calculated values obtained from the test runs of this heat exchanger. In Table I, the water flow is measured in gallons per minute (GPM), steam pressure is measured in pounds per square inch absolute (psia) and q is measured in Btu's per hour and represents the number of Btu's per hour that transfer from the service side of the heat exchanger to the process side. $T_{LM}$ is the log mean of the temperatures and represents the average temperature differential between the service and process fluids throughout the entire cross section of core member 13. $T_{LM}$ represents the average driving force of energy moving from the heated service steam to the cooler process water. $U_{AI}$ is a measure of the Btu/hour, in degrees Fahrenheit, per square foot of internal surface area of the passageways for the process fluid that are transferred to the process fluid. This is a measure of the efficiency of the heat exchanger.

TABLE 1

| $H_2O$ (GPM) | $H_2O$ in °C. | $H_2O$ Out °C. | Steam pressure (psia) | Q btu/hour | $T_{LM}$ °F. | $U_{AI}$ (2 sq ft) Btu/hr °F. sq ft |
|---|---|---|---|---|---|---|
| 10 | 5 | 43 | 80 | 342,478 | 234.5 | 730 |
| 10 | 5 | 46 | 100 | 369,492 | 246.6 | 749 |
| 8.8 | 5 | 49 | 100 | 348,945 | 246.8 | 707 |
| 8.8 | 5 | 51 | 105 | 364,806 | 244.1 | 747 |
| 6.5 | 5 | 65 | 120 | 351,468 | 240 | 732 |
| 6.5 | 5 | 62 | 115 | 333,895 | 239.5 | 697 |
| 4.4 | 5 | 84 | 130 | 313,257 | 225.3 | 695 |

This same heat exchanger was also tested for resistance to thermal shock by turning off the water and letting it reach full steam pressure and then instantanously turning on the cold water. This was repeated several times and the heat exchanger then checked for steam leaks at full pressure. None were found.

EXAMPLE 2

A heat exchanger with a monolithic core member as shown in FIGS. 6 and 7 was made in the following manner. Vermicular expanded graphite was pressed into a sheet using a modified calendar press. These sheets varied in thickness from about 0.02 inch to 0.08 inch. A number of sheets were thus made and were then cut into 3 inch by 6½ inch rectangular pieces. These pieces were then stacked up and placed in a plastic bag, and a vacuum pump attached to the bag to remove the air. This was done in order to avoid trapping air inside the expanded graphite structure upon compression. While still in the plastic bag under vacuum, the stack of rectangular pieces of expanded graphite was transferred to a ram press and pressed under about 40,000 pounds of force. This amounted to a pressure of 2,051 pounds per square inch. The effect of this compression was to laminate these rectangular pieces into a monolithic block. Twelve holes were then cut in this block (which was approximately 2.3 inches thick). Header plates were made in a manner similar to that used for making the core member. Header covers made of steel plate, and having the dimensions of 9 inches by 6 inches by ½ inch, were fitted over the core and header plates, and were clamped together by means of bolts 46 as shown in FIG. 7. These bolts were tightened to approximately 25 foot pounds which caused the core member and header plates, which measured a total thickness of 3.1 inches, to be compressed to a thickness of 2.7 inches. It will be noted that this compression was in the direction of axis C—C as shown in FIG. 6. This is, of course, the same axis of compression used in making core member 40. Thermometers were placed in the stream of each conduit 50, 47, 48 and 49, and water was then run through each side of the heat exchanger with no observable leakage.

In order to test the operation of the heat exchanger, hot water was run through the service side of the heat exchanger (conduits 50 and 47) and cold water was run through the process side of the heat exchanger (conduits 48 and 49). Heat traveled from the service fluid (passing through holes 41) to the process fluid (passing through holes 42). Thus, the heat was exchanged along an axis parallel to D—D and normal to the axis of compression of C—C. The following table shows the data obtained:

TABLE 2

| | Rate of Flow | T (in) | T (out) |
|---|---|---|---|
| Hot Water | 500 ml/25 sec | 50° C. | 39° C. |
| Cold Water | 500 ml/28 sec | 21.5° C. | 33° C. |

As a further test of the heat exchanger, steam was then run through the service side of the heat exchanger and cold water through the process side with the following results:

TABLE 3

| | Rate of Flow | T (in) | T (out) |
|---|---|---|---|
| Steam | 100 ml (cond)/60 sec | 94° C. | 70° C. |
| Cold Water | 500 ml/36 sec | 21.5° C. | 46.5° C. |

As used in this specification and the following claims, references to passage of fluid "through" the core member is intended to include any contact between the fluid and core member, including peripheral contact as shown for the service fluid entering through inlet 22 in FIG. 1.

Among the many advantages of heat exchangers embodying the present invention over the prior art are higher thermal conductivity, significantly greater resistance to thermal shock, ease of construction and repair due to moldability of the compressed expanded graphite, and the self gasketing characteristics of this form of graphite. Major advantages of the present invention also include capability of constructing a core member of pure graphite, requiring no additives, and thus being usable at very high temperatures. This and other advantages described above result in a heat exchanger of outstanding durability, especially under stress conditions of heat and chemical corrosion.

Numerous modifications and variations of the particular embodiments of the present invention above described, may be made without departing from the scope of the present invention as defined in the following claims.

What is claimed is:

1. A method for exchanging heat between two or more fluids, which comprises passing a first fluid through a core member made up of a plurality of plates made by compressing a composition containing essentially vermicular expanded graphite substantially more along one axis than along the other two axes, and passing a second fluid through said core member in separate but heat exchange relationship with said first fluid in such a manner that the primary exchange of heat between the two fluids is through the core member along an axis of the core member that is normal to the axis of substantial compression under which said core member is formed.

2. The method of claim 1 wherein the composition compressed to make the core member includes an additive.

3. The method of claim 2 wherein the additive is a bonding agent.

4. The method of claim 3 wherein the bonding agent is polytetrafluoroethylene.

5. The method of claim 3 wherein the bonding agent is a glass forming composition.

6. A heat exchanger comprising a core member made up of a plurality of plates made by compressing a composition containing essentially vermicular expanded graphite substantially more along one axis than the other two axes, a first means for passing a first fluid through said core member and a second means for passing a second fluid through said core member in separate but heat exchange relationship with said first fluid, said first and second means being so positioned with respect to one another that the primary heat exchange of heat between the two fluids is along an axis of the core member that is normal to the axis of substantial compression under which said core member is formed.

7. Apparatus as claimed in claim 6 wherein the composition compressed to form the core member includes a bonding agent.

8. Apparatus as claimed in claim 6 which includes means for compressing said plates against one another along an axis parallel to the axis of compression used in making the plates.

9. Apparatus as claimed in claim 8 wherein the means for compressing said plates produces a compression of at least 100 pounds per square inch.

10. Apparatus as claimed in claim 6 wherein the core member is made by compressing the vermicular expanded graphite to a density of at least 100 pounds per cubic feet.

11. A method for effecting the exchange of heat between a first fluid and a second fluid, which comprises passing the first fluid through a core member made by compressing a composition consisting essentially of vermicular expanded graphite, the direction of compression being substantially greater along one axis than along the other two, maintaining the core member under compression along the axis of substantial compression under which said core member is formed and passing the second fluid through said core member in heat exchange relationship with said first fluid in such a manner that heat is exchanged between the two fluids through the core member in a direction normal to the axis of compression of said core.

12. In a heat exchanger comprising a fluid tight shell, a core member positioned within the shell, a first means providing passageway into and out of the shell for a first fluid and a second means for providing passageway into and out of the shell for a second fluid, the improvement which comprises a plurality of plates which together compose said core member, said plates being made by compressing vermicular expanded graphite in the direction of the thickness of said plates to a density of at least about 100 pounds per cubic foot, means for compressing said plates against one another under a pressure of at least about 100 pounds per square inch in the direction of their original compression so as to avoid passage of fluid between the interfaces of said plates, means formed in said plates and connected to said first means for providing passageways for the first fluid through said core member, means formed in said plates and connected to said second means for providing passageways through said core member or said second fluid, said passageways for the first and second fluids being separate from but in heat exchange relationship with one another in a direction normal to the direction of compression of the plates.

* * * * *